US011208185B2

(12) United States Patent
Sang

(10) Patent No.: US 11,208,185 B2
(45) Date of Patent: Dec. 28, 2021

(54) SNORKELING BREATHING APPARATUS

(71) Applicant: Shenzhen Qianhai Huajinkangbei Technology Co., Ltd., Shenzhen (CN)

(72) Inventor: Qingdong Sang, Shenzhen (CN)

( * ) Notice: Subject to any disclaimer, the term of this patent is extended or adjusted under 35 U.S.C. 154(b) by 288 days.

(21) Appl. No.: 16/299,164

(22) Filed: Mar. 12, 2019

(65) Prior Publication Data

US 2020/0115015 A1 Apr. 16, 2020

(30) Foreign Application Priority Data

Oct. 15, 2018 (CN) ..... 201811200449.7
Oct. 15, 2018 (CN) ..... 201821670881.8
Oct. 15, 2018 (CN) ..... 201821670898.3
Oct. 15, 2018 (CN) ..... 201821671341.1
Oct. 15, 2018 (CN) ..... 201821671485.7

(51) Int. Cl.
*B63C 11/16* (2006.01)
*B63C 11/20* (2006.01)
*A62B 18/02* (2006.01)
*A62B 9/02* (2006.01)
*A62B 18/10* (2006.01)

(52) U.S. Cl.
CPC ..... *B63C 11/16* (2013.01); *A62B 9/02* (2013.01); *A62B 18/02* (2013.01); *A62B 18/10* (2013.01); *B63C 11/205* (2013.01); *B63C 2011/165* (2013.01)

(58) Field of Classification Search
CPC ..... B63C 11/00; B63C 11/02; B63C 11/12; B63C 11/16; B63C 11/205; B63C 11/20; B63C 2011/125; B63C 2011/165; A61M 16/20; A61M 16/208; A61M 16/209; A61M 16/206; A62B 7/00; A62B 9/00; A62B 9/02; A62B 18/00; A62B 18/02; A62B 18/04; A62B 18/10; A62B 18/08
USPC ..... 128/201.11
See application file for complete search history.

(56) References Cited

U.S. PATENT DOCUMENTS 5,954,051 A * 9/1999 Heinonen ..... A61M 16/204 128/205.24
6,302,102 B1 * 10/2001 Giroux ..... B63C 11/205 128/201.11
6,668,823 B1 * 12/2003 Liu ..... B63C 11/16 128/201.11
2002/0190866 A1 * 12/2002 Richardson ..... A62B 9/006 340/632
2017/0096204 A1 * 4/2017 Cucchia ..... B63C 11/16
2018/0134352 A1 * 5/2018 Armani ..... B63C 11/26
2019/0023366 A1 * 1/2019 Liao ..... B63C 11/16
2020/0031441 A1 * 1/2020 YiHong ..... B63C 11/16
2020/0102059 A1 * 4/2020 Wung ..... B63C 11/16

* cited by examiner

*Primary Examiner* — Colin W Stuart

(57) ABSTRACT

A snorkeling breathing apparatus includes a mask, a first breathing tube assembly and a one-way exhaust valve. The mask includes an outer mask and a breathing mask arranged in the outer mask, the mask is equipped with a breathing chamber. The breathing tube assembly includes a first breathing tube and a one-way inhaling valve. The breathing tube is connected to the breathing mask through the inhaling valve. The exhaust valve is connected and mounted on the outer mask and the breathing mask. While inhaling, the inhaling valve conducts and air enters the chamber through the breathing tube. While exhaling, the exhaust valve conducts and air flows from the chamber to outside.

13 Claims, 10 Drawing Sheets

SNORKELING BREATHING APPARATUS

BACKGROUND OF INVENTION

1. Field of Invention

The present disclosure relates to the technical field of diving equipment, and particularly relates to a snorkeling breathing apparatus.

2. Description of Prior Art

As a recreational sport, swimming underwater is becoming popular among more and more people. A snorkeling breathing apparatus, can help users breathe freely in the process of diving, and it is an essential equipment for diving.

At present, there are two types of commonly used snorkeling breathing apparatus: one is a mouth-bite type breathing apparatus, which requires user to open his or her mouth to breath. It will not only easily make the apparatus fall off, but also easily intake water causing breathing dyspnea. The other type is all-dry breathing apparatus which adopts a same breathing tube to form a suction channel and an exhaust channel therein for inhaling and exhaling air. However, in the case of inhaling air, due to the exhaled carbon dioxide hasn't been exhausted completely in time, the inhaled fresh air and the exhaled carbon dioxide will easily mix together and be inhaled together by the user, thus the volume of fresh air inhaled by the user will decrease, which will lead to the user's anxiety, chest congestion, and will easily cause asphyxia and breathing dyspnea. Thus, the present breathing structure of snorkeling breathing apparatus may easily lead to breathing dyspnea in use, and is a threat to the user's safety during his or her diving sports.

SUMMARY OF INVENTION

The main purpose of the present disclosure is to provide a snorkeling breathing apparatus which aims at making an innovation to the breathing system by separating the exhalation and suction mechanically, to make sure that the air in the breathing cavity is always fresh, and to increase the safety performance of snorkeling breathing apparatus. Thus life safety will be truly guaranteed through the system and freely breath underwater will be truly realized. Specifically, the present disclosure provides a snorkeling breathing apparatus, comprising:

a mask comprising an outer mask and a breathing mask, the breathing mask being provided within the outer mask and equipped with a breathing chamber;

a first breathing tube assembly comprising a first breathing tube and a non-return inhaling valve, the first breathing tube being connected to the breathing mask through the non-return inhaling valve; alternatively, the non-return inhaling valve being arranged in the first breathing tube and the first breathing tube being connected to the breathing mask directly; and a non-return inhaling valve being connected and mounted on the outer mask, wherein when, a user inhales, the non-return inhaling valve turns on and the external air enters the breathing chamber through the first breathing tube; when the user exhales, the non-return exhaust valve turns on and the exhaled air flows from the breathing chamber to the outside of the outer mask.

Optionally, wherein the non-return exhaust valve comprises a first non-return exhaust valve and a second non-return exhaust valve.

Optionally, wherein when the user exhales, the first non-return exhaust valve conducts; and the second non-return exhaust valve is connected with an airflow sensor to control the conducting or closing state of the second non-return exhaust valve according to the volume of exhaled air.

Optionally, wherein the snorkeling breathing apparatus further comprises a V-shaped strip, the V-shaped strip being provided on the upper portion of the breathing mask for fitting with user's face.

Optionally, wherein the outer mask is equipped with a wearable opening to fit with user's face;

the outer mask comprises:

a protective pad extending along the edge of the wearable opening in circle, the protective pad, being provided on the peripheral surface of the edge of the wearable opening; and a pressing ring being arranged around the peripheral surface of the wearable opening, wherein the inner surface of the pressing ring comprises a fixing member and a compressing-jointing member arranged along the pressing ring in an axial direction, the compressing jointing member is arranged near the wearable opening, the fixing member is connected to the peripheral surface of the edge of the wearable opening, and the protective pad is hermetically positioned on the peripheral surface of the edge of the wearable opening by the compressing-jointing member.

Optionally, wherein the fixing member comprises a first annular baffle and a second annular baffle being arranged along the inner surface of the pressure ring and protruding to the inner side, and an annular slot being formed between and separating the first and second annular baffle, the peripheral surface of the edge of the wearable opening is provided with an annular fixing rib for matching with the annular slot.

Optionally, wherein the snorkeling breathing apparatus further comprises a second breathing tube assembly comprising a second breathing tube and a second non-return valve, the second breathing tube being connected to the breathing mask through the second non-return valve; alternatively, the second non-return valve being arranged in the second breathing tube and the second breathing tube being connected to the breathing mask directly.

Optionally, wherein the second non-return valve is used as a non-return inhaling valve, and the second breathing tube is connected to the breathing mask via the non-return inhaling valve; alternatively, the non-return inhaling valve is arranged in the second breathing tube, and the second breathing tube is connected to the breathing mask directly.

Optionally, wherein the first breathing tube assembly and the second breathing tube assembly are rotatably connected to the breathing mask.

Optionally, wherein the non-return inhaling valve is provided with a first end and a second end opposite to each other, the breathing mask is provided with a first mounting hole, the first end is hermetically connected to the first mounting hole, the second end is hermetically connected to one end of the first breathing tube, and the end of the first breathing tube is rotatably connected to the second end.

Optionally, wherein the non-return inhaling valve comprises a first connecting segment, a baffling segment and a second connecting segment arranged successively in an axial direction, the first connecting segment fixes and runs through the first mounting hole, the baffling segment protrudes from the peripheral surface of the first connecting segment to limit the insertion depth of the first connecting segment;

the non-return inhaling valve further also comprises a fixing sleeve located in the breathing chamber, which fixing sleeve is detachably provided on the peripheral surface of the first connecting, segment so as to fixedly hold the non-return inhaling, valve in the first mounting hole;

the end of the first breathing tube is connected to the second connecting segment.

Optionally, wherein the non-return inhaling valve comprises:

a valve body being arranged in a cylinder shape, and both two ends of the valve body in axial direction are configured as an opening, the valve body being equipped inside with a mounting plate, the periphery edge of the mounting plate being connected to the inner wall of the valve body, the mounting plate being equipped with ventholes;

a valve sheet being provided on the mounting plate for opening or covering the ventholes, both sides of the mounting plate in the valve body being provided with accommodation space for accommodating the valve sheet.

Optionally, wherein a second mounting hole is arranged in the middle of, the mounting plate, the valve sheet comprises a sheet body and a mounting column connected to the sheet body, and the mounting column runs through the second mounting hole and fixes on the mounting plate.

Optionally, wherein a ring cylinder is also provided between the periphery of the mounting plate and the inner wall of the valve body, and the sheet body overlaps on one of the end face of the, ring cylinder in an axial direction.

Optionally, wherein the end face of the ring cylinder is provided with a convex rib, and the sectional view of the convex rib is formed as a triangular shape.

The technical solution of the present invention adopts the first breathing mask, the first breathing tube assembly and the non-return exhaust valve. On the one hand, the first breathing tube of the first breathing tube assembly is connected to the breathing mask of the mask through the first breathing tube. Or the non-return inhaling valve is arranged in the first breathing tube which is connected to the breaking mask directly. When the user inhales, the non-return inhaling valve conducts and air flows into the breathing chamber through the first breathing tube. On the other hand, the exhaust non-return valve is connected and provided on the outer mask of the mask and the breathing mask. When the user exhales, the non-return exhaust valve conducts and the exhaled air flows to the outside through the non-return exhaust valve. Air can only enter by mounting the non-return inhaling valve through the first breathing tube; meanwhile, the carbon dioxide exhales instantaneously and largely outside through the non-return exhaust valve and the exhaled air can be discharged smoothly without entering water. The present invention especially aims at innovating the respiratory system to separate the exhalation and suction by mechanical separation. It can ensure that the air in the breathing chamber is always fresh so the life safety will be truly guaranteed through the system. By improving the safe performance of the breathing, apparatus, it can truly realize freely breath underwater.

BRIEF DESCRIPTION OF DRAWINGS

The embodiment of the present invention will be more clearly understood from the following, drawings. It is obvious that the following described drawings are only some embodiments of the invention. For the person skilled in the art, he can achieve the other drawings from the structures shown in these drawings without, any creative work.

Figure 1:
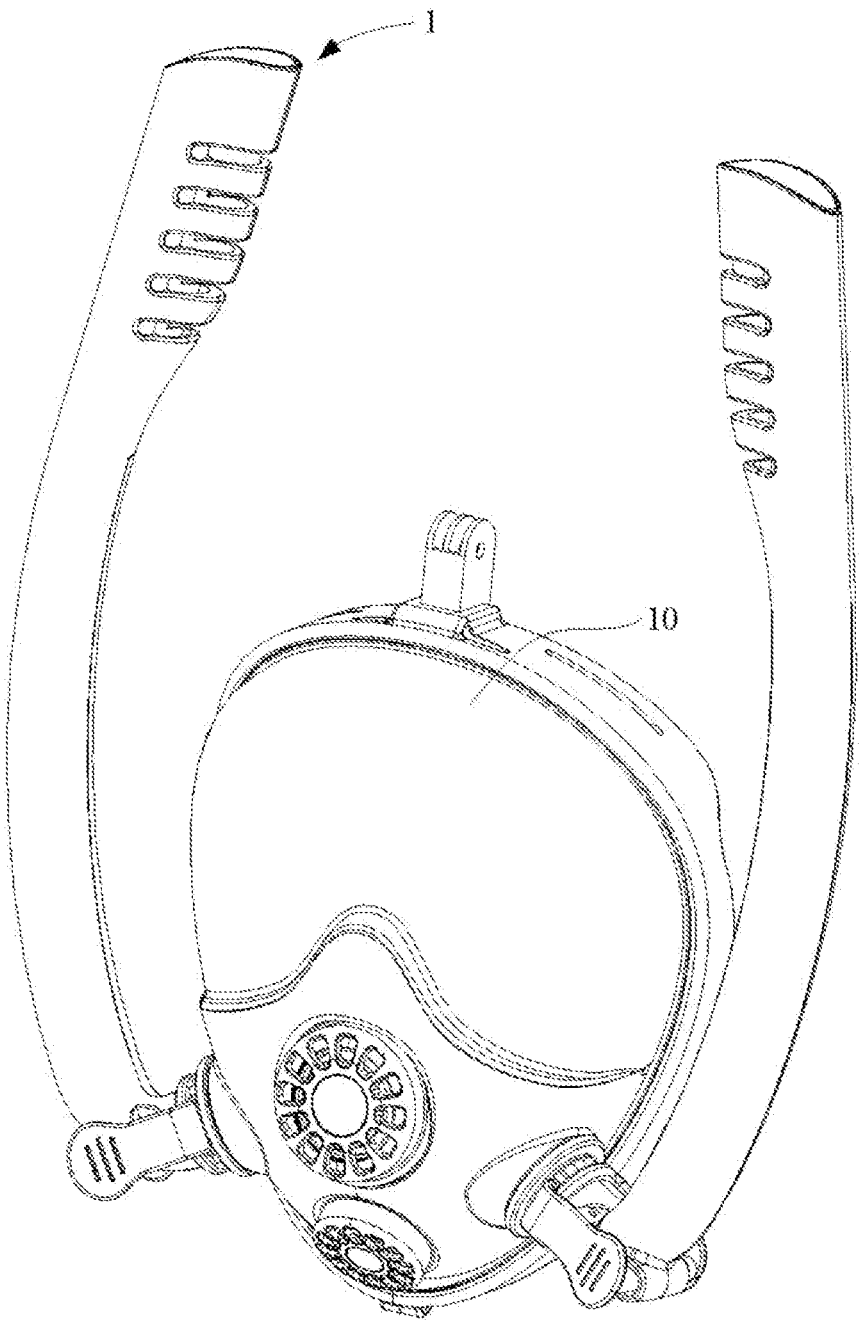
FIG. 1 is a schematic view of the outside structure of a snorkeling breathing apparatus according to the present invention.

The realization of the purpose, the functional characteristics and the advantages of the invention shall be further explained by combining with the embodiment and by referring to the drawings.

DETAILED DESCRIPTION OF PREFERRED EMBODIMENTS

The technical solution in the embodiments of the invention will be clearly and completely described, by combining with the drawings in the embodiments of the invention. Apparently, the described embodiments are only parts of the embodiments of the invention, but not all of the embodiments. Based on these embodiments, all the other embodiments that the person skilled in the art can achieve without making creative work, are belong to the, scope of protection of the invention.

The present invention discloses a snorkeling breathing apparatus. Referring from FIG. 1 to FIG. 3, in the embodiments of the present invention, the snorkeling breathing apparatus 1 comprises a mask 10, a first breathing tube assembly 20, and a non-return exhaust valve 30, wherein, the mask 10 comprises an outer mask 11 and a breathing mask 12. The breathing mask 12 is arranged within the outer, mask 11 and provided with a breathing chamber 121. The first breathing tube assembly 20 comprises a first breathing tube 21 and a non-return inhaling valve 22, and the first breathing tube 21 connects to the breathing mask 12 through the non-return inhaling valve 22. Alternatively, the non-return inhaling valve 22 is arranged in the first breathing tube 21, and the first breathing tube 21 is directly connected to the breathing mask 12. The non-return exhaust valve 30 is configured to be connected and mounted on the outer mask 11 and the breathing mask 12. When the user inhales, the non-return inhaling valve 22 turns on while the non-return exhaust valve 30 turns off, so the outside air enters the breathing chamber 121 through the first breathing tube 21.

When the user exhales, the non-return exhaust valve 30 turns on, while the non-return inhaling valve 22 turns off, so the exhaled air flows from the breathing chamber 121 to the outside of the outer mask 11.

There is one point needed to be emphasized is that compared with the case that the non-return inhaling valve 22 is provided further from the breathing mask 12, in the case that the first breathing tube 21 is connected to the breathing mask 12 through the non-return inhaling valve 22, as the non-return inhaling valve 22 is provided rather close to the breathing mask 12, the air leakage can be reduced when the user inhales, and a more apparent negative pressure can be formed so as to inhale more outside air, and to realize a better breath changing effect.

Specifically, the mask 10 is used for wearing, and helping user breathe freely underwater. The outer mask 11 is mainly used for protecting user's face, and in general, the outer mask 11 is overall made of transparent material so as to provide a good field of view underwater. Apparently, it can also be that only the area corresponding to the user's eyes is made of transparent material to make the shape of the mask 11 changeable The breathing mask 12 is mounted within the outer mask 11 and used for breathing and wearing. The breathing mask 12 is provided with the breathing chamber 121, by which the user can breathe when in use. At the same time, the breathing part and the eyes part are separated by the breathing mask 12, so as to avoid the exhaled air producing fog on the outer mask 11 and therefore affecting the field of view. Preferably, the breathing mask 12 is made of silica gel.

In order to improve the breathing structure of the snorkeling breathing apparatus 1 and to avoid mixing the inhaled fresh air with the exhaled carbon dioxide, the first breathing tube assembly 20 and the non-return exhaust valve 30 are used in this embodiment.

The first breathing tube assembly 20 comprises the first breathing tube 21 and the non-return inhaling valve 22 (also called forward non-return valve). The first breathing tube 21 is arranged on the outside of the outer mask 11, meanwhile, a first mounting hole 111 is provided on the outer mask 11 to realize the installation of the first breathing tube 21 and the non-return inhaling valve 22. There are two installation ways of connecting the breathing tube 21 with the non-return inhaling valve 22. One is to make the first breathing tube 21 through the first mounting hole 111, connected and installed to the breathing mask 12 by the non-return inhaling valve 22, so as to connect the breathing chamber 121 with the outside environment. Specifically, the non-return inhaling valve 22 is provided on the bottom of the first breathing tube 21 in order to make the first breathing tube 21 with the longest length, which will have a good flexibility and adaptability to the diving depth in use. The other way is to arrange the non-return inhaling valve 22 inside the first breathing tube 21 which is connected and mounted to the breathing mask 12 through the first mounting hole 111. By using the non-return inhaling valve 22, when the user inhales, the first breathing tube 21 conducts to the breathing chamber 121, and air can only flow into the breathing chamber 121 through the first breathing tube 21 and thus an air inlet channel is formed.

The non-return exhaust valve 30 (also called reverse non-return valve) is connected and installed to the outer mask 11 and the breathing mask 12 to make the breathing chamber 121 connect to the outside environment. When exhaling, the air exhales directly to outside environment through the non-return exhaust valve 30 and thus air flowing back is prevented. Since the air is exhausted directly through the non-return exhaust valve 30, and the exhaling channel is rather short, the air thus can be discharged quickly and the exhaled air mixing with the inhaled fresh air can be further avoided. Besides, due to the installation of the later described V-shaped strip 14 and the protective pad 13, which strip 14 and pad 13 make user's face much closer to the breathing mask 12 and the outer mask 11 respectively, thus it's prevented that the air leaks from the gap between the outer mask 11 and the face when the user exhales, which, air leakage will directly affect the exhaust performance of the non-return exhaust valve 30. Furthermore, it can also prevent the air leaking from the gap between the V-shaped strip 14 and user's face to the eyes area (namely the later hollow chamber), which will also affect the exhaust performance.

Apparently, by adopting the first breathing tube assembly 20 and the non-return inhaling valve 22, an air inlet channel connecting the first breathing tube 21 and the breathing mask 12 can be formed, through which air can only enter. Meanwhile, by adopting the non-return exhaust valve 30, an air exhaust channel can be formed, through which air can be discharged widely and rapidly in a moment. By mechanically separating the inhalation and exhalation of the breathing system, the mixing of the inhaled fresh air and the exhaled air in the breathing mask 12 can be effectively avoided.

The technical solution of the invention adopts the mask 10, the first breathing tube assembly 20 and the non-return exhaust valve 30. On the one hand, the first breathing tube 21 of the first breathing tube assembly 20 is connected to the breathing mask 12 of the mask 10, or the non-return inhaling valve 22 is provided inside the first breathing tube 21, wherein the first breathing tube 21 is connected to the breathing mask 12, so that when the user inhales, the inhaling valve 22 will, conduct (turn on) and fresh air will flow into the breathing chamber 121 through the first breathing tube 21. On the other hand, the non-return exhaust valve 30 is mounted and connected to the outer mask 11 and the breathing mask 12 of the mask 10, so that when the user exhales, the non-return exhaust valve 30 will conduct and the exhaled air will flow to outside environment through the non-return exhaust valve 30. Due to the combination of the non-return inhaling valve 22 and the first breathing tube 21 air can only enter; meanwhile, due to the installation of the non-return exhaust valve 30, the exhaled carbon dioxide can be discharged instantaneously, heavily and smoothly outside, without any water percolation. The technical solution of the invention especially aims at making an innovation to the breathing system by separating the exhalation and suction mechanically, which can ensure that the air in the breathing chamber 121 is always fresh so the life safety can be truly guaranteed through the system, the safe performance of the breathing apparatus can be improved, and the freely breath underwater can be truly realized.

Figure 2:
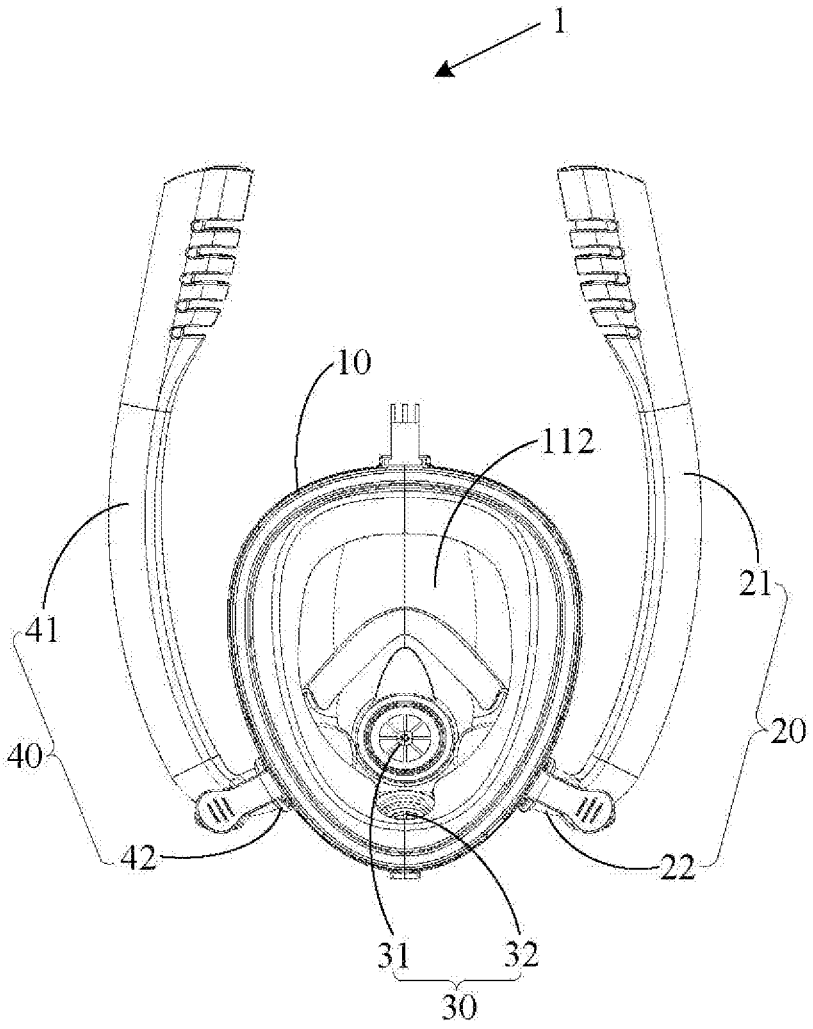
FIG. 2 is a schematic view of the inside structure of the snorkeling breathing apparatus according to the present invention.

Referring to FIG. 2, the snorkeling breathing apparatus 1 also comprises a second breathing tube assembly 40, which includes a second breathing tube 41 and a non-return valve 42. The second breathing tube 41 is connected to the breathing mask 12 through the non-return valve 42. Alternatively, the non-return valve 42 is arranged in the second breathing tube 41 and the second breathing tube 41 is connected to the breathing mask 12 directly. By using the second breathing tube assembly 40 and connecting the second breathing tube 41 with the breathing mask 12, the volume of air inhaled or exhaled by the breathing mask 12 can be increased, and thus the using, performance of the snorkeling breathing apparatus 1 can be improved.

In one embodiment, the non-return valve 42 can be used as a non-return inhaling valve 22, and the second breathing tube 41 is connected to the breathing mask 12 via the non-return inhaling valve 22. Alternatively, the non-return inhaling valve 22 is arranged in the second breathing tube 41, and the second breathing tube 41 is connected to the breathing mask 12. Since snorkeling sport takes a long time under water, it can significantly improve the using experience of the snorkeling, breathing apparatus 1 by increasing the air suction volume of the breathing mask 12. Therefore, if the non-return valve 42 in the second breathing tube assembly 40 is used as the non-return inhaling valve 22 which allows air to flow into the breathing chamber 121 through the second breathing tube 41, air volume in the breathing chamber 121 can be increased, and the using performance can be improved. Of course, the non-return valve 42 can alternately be used as a non-return exhaust valve 30 to improve the exhalation rate.

Figure 3:
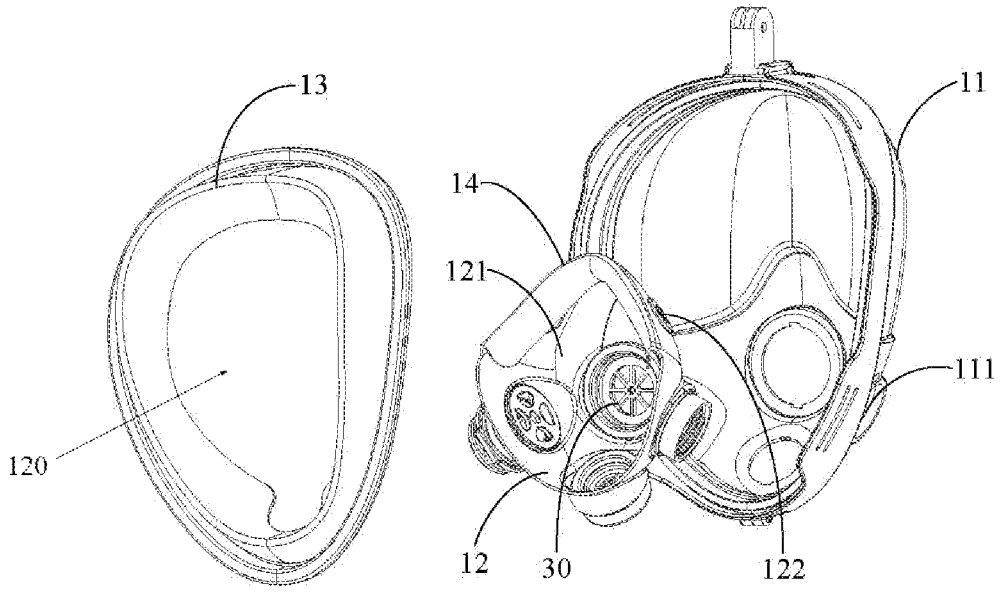
FIG. 3 is an exploded view of the snorkeling breathing apparatus in FIG. 2.

Referring to FIG. 2 and FIG. 3, there is a hollow chamber 112 formed between the inner side of the outer mask 11 and the outer side of the, breathing mask 12. The breathing mask 12 is provided with a through-hole 122 which associates the hollow chamber 112 with the breathing chamber 121. By mounting the breathing mask 12 inside the outer mask 11, different areas are formed in the inner side of the outer mask 11: the breathing chamber 121 is formed inside the breathing mask 12, and the hollow chamber 112 is formed between the breathing mask 12 and the outer mask 11. The through-hole 122 which associates the breathing chamber 121 with the hollow chamber 112, is provided on the breathing mask 12. The air in the breathing chamber 121 inhaled by the user will flow into the hollow chamber 112 via the through-hole 122, thus a temporary air storage space is formed and the air storing volume is increased. Therefore, the using time underwater is prolonged when both the first breathing tube 21 and the second breathing tube 41 are immersed into the water, and the using performance of the product is improved.

Referring to FIG. 3, the snorkeling breathing apparatus 1 also comprises a V-shape strip 14, which is provided on the upper portion of the breathing mask 12 for fitting with user's face. The breathing mask 12 has a better fitting effect with the face through the V-shape strip 14, which is not only good for enhancing the sealing effect, but also makes the wearing more comfortable, and thus improves the wearing experience. Silica gel is in a good flexibility so the V-shaped strip 14 is preferably made of silica gel.

In an embodiment, as shown in FIG. 1 and FIG. 2, the non-return exhaust valve 30 comprises a first non-return exhaust valve 31 and a second non-return exhaust valve 32. By adopting the two exhaled valves 30, both of the non-return exhaust valves 30 are connected to the breathing mask 12 and the outer mask 11. When the user exhales, at least a non-return exhaust valve 30 conducts. That is, in the practical application scheme, only one non-return exhaust valve conducts or both two non-return exhaust valves conduct together. Alternately, a non-return exhaust Valve 30 conducts and the other non-return valve 30 conducts or closes according to the volume of exhaled air. By the installation of the two non-return exhaust valves 30, the outflowing channel of the exhaled air is magnified, thus the exhaled air can be discharged more rapidly, the exhalation efficiency can be more significantly improved, and the exhaled air mixing with fresh air in the breathing chamber 121 can be more effectively avoided. Both of the two non-return exhaust valves 30 can be arranged at any position of the breathing mask 12. In this embodiment, the second non-return exhaust valve 32 is provided on the breathing mask 12 in front of user's mouth and the first non-return exhaust valve 31 is provided on the bottom of the breathing mask 12 in front of user's nose, thus both of the first and second non-return exhaust valve are arranged along with the flowing direction of, the exhaled air, which can further improve the air outflow rate.

Since the breathing chamber 121 is directly connected to the external through the non-return exhaust valve 30, the distance of air outflowing, is shortened. In addition, both of the two non-return exhaust valves 30 conduct at a same time and thus the outflowing volume of the air is increased, so that the air exhaled can flows out rapidly, thus the efficiency of exhalation is significantly improved. It can also avoid the fresh air mixing with the air exhaled and significantly reduce the uncomfortable feeling of chest tightness and suffocation, and significantly improve the safety performance of the snorkeling breathing apparatus 1.

Alternately, when the user exhales, the first non-return exhaust valve 31 conducts; the second non-return exhaust valve 32 is equipped with an airflow sensor (not shown in drawings) to control the conducting or closing state of the second non-return exhaust valve 32 according to the volume of exhaled air. By adopting the airflow sensor, when the expiratory volume is large, the second non-return exhaust valve 32 senses the increased airflow and conducts to magnify the outflow channel and thus the exhaled air discharges rapidly. When the expiratory volume is small, the second non-return exhaust valve 32 closes, and the exhaled air discharges through the first non-return exhaust valve 31, thus the use flexibility is improved.

Figure 4:
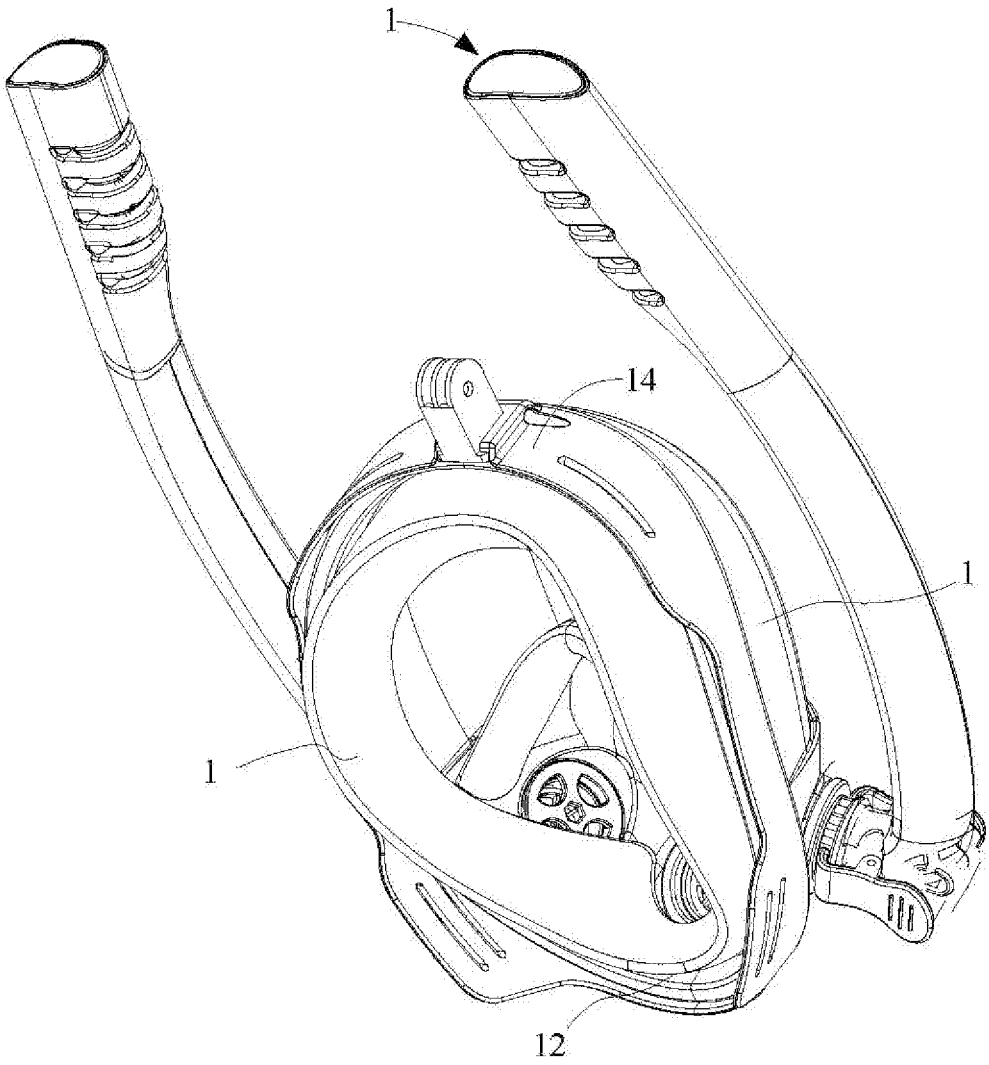
FIG. 4 is a schematic view of a protective pad arranged on the wearable opening.

In another embodiment, as shown in FIG. 4, the mask 10 comprises a wearing opening 120 connected to the breathing chamber 121. The wearing opening 120 fits the user's face, and user's mouth, nose and eyes can be covered within the breathing chamber 121. When the user wears the snorkeling breathing apparatus 1 for swimming or diving, the wearing opening 120 of the mask 10 hermetically fits with the user's face so as to prevent water entering into the breathing chamber 121.

Furthermore, as shown in FIG. 4, the wearable opening 120 is equipped with a protective pad 13 which extends along the edge of the wearable opening 120 in a circle, the protective pad 13 is provided on the peripheral surface of the edge of the wearable opening 120, and a pressing ring 140 is also equipped around the peripheral surface of the edge of the wearable opening 120.

As shown in FIG. 4 to FIG. 7, the inner surface of the pressing ring 140 comprises a fixing, member 141 and a compressing-jointing member 142 arranged along, the pressing, ring 140 in an axial direction. The compressing-jointing member 142 is arranged near the wearable opening 120 and the fixing member 141 is connected to the peripheral surface of the edge of the wearable opening 120. The protective pad 13 is hermetically positioned on the peripheral surface of the edge of the wearable opening 120 by the compressing-jointing member 142.

The purpose of arranging the protective pad 13 is to better realize the wearing opening 120 matching with user's face, so as to achieve a sealing good effect and improve the user's touching comfort. The protective pad 13 is made of elastic or flexible materials, wherein, a soft silicone piece is preferably used as protective pad 13 as the silicone piece is of good water resistance and harmless to user's skin. Therefore, it can not only hermetically prevent water, but also improve the touching comfort with user's skin.

The pressing ring 140 is arranged around the peripheral surface of the edge of the wearable opening 120 so as to fixedly hold the protective pad 13 on the mask 10. In order to ensure that the pressing ring 140 can be reliably fixed on the mask 10, in this embodiment, the inner surface of the pressing ring 140 includes the fixing member 141 and the compressing-jointing member 142, the protective pad 13 is hermetically positioned on the peripheral surface of the edge of the wearable opening 120 by the compressing-jointing member 142, and the fixing member 141 is connected to the peripheral surface of the edge of the wearable opening 120, therefore the reliable connection between the pressing ring 140 and the mask 10 is ensured, thus the protective pad 13 can be clamped firmly between the pressing ring 140 and the mask 10, the loosening risk of protective pad 13 is reduced, and thus the protective pad 13 can be ensured with a better sealing effect.

In this embodiment, the pressing ring 140 should have high strength so as to firmly hold the protective pad 13 on the mask 10. Engineering plastics have the advantages of high strength, small density, low cost, etc., so that the pressing ring 140 can be made of engineering plastics. The engineering plastics for making the pressing ring 140 comprise but not limit to polyethylene (PE), polypropylene (PP), polyvinyl chloride (PVC), polycarbonate (PC) and ABS plastics.

Figure 5:
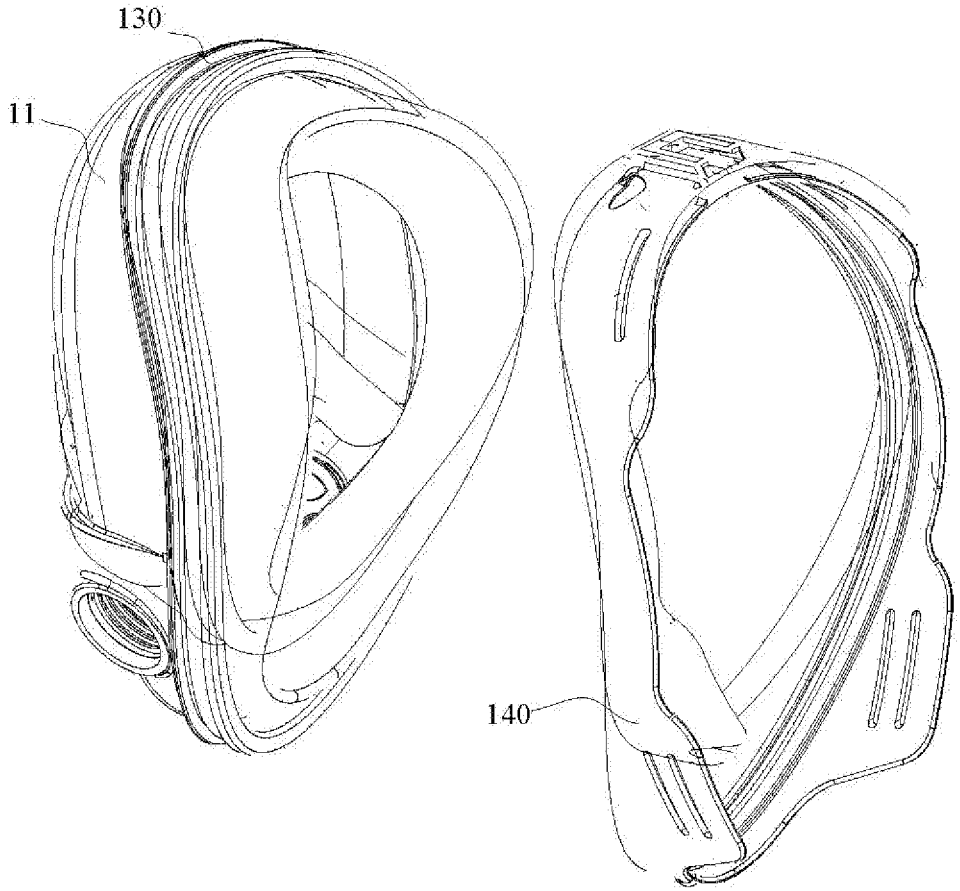
FIG. 5 is a schematic view of a pressing ring in a detached state.
Figure 6:
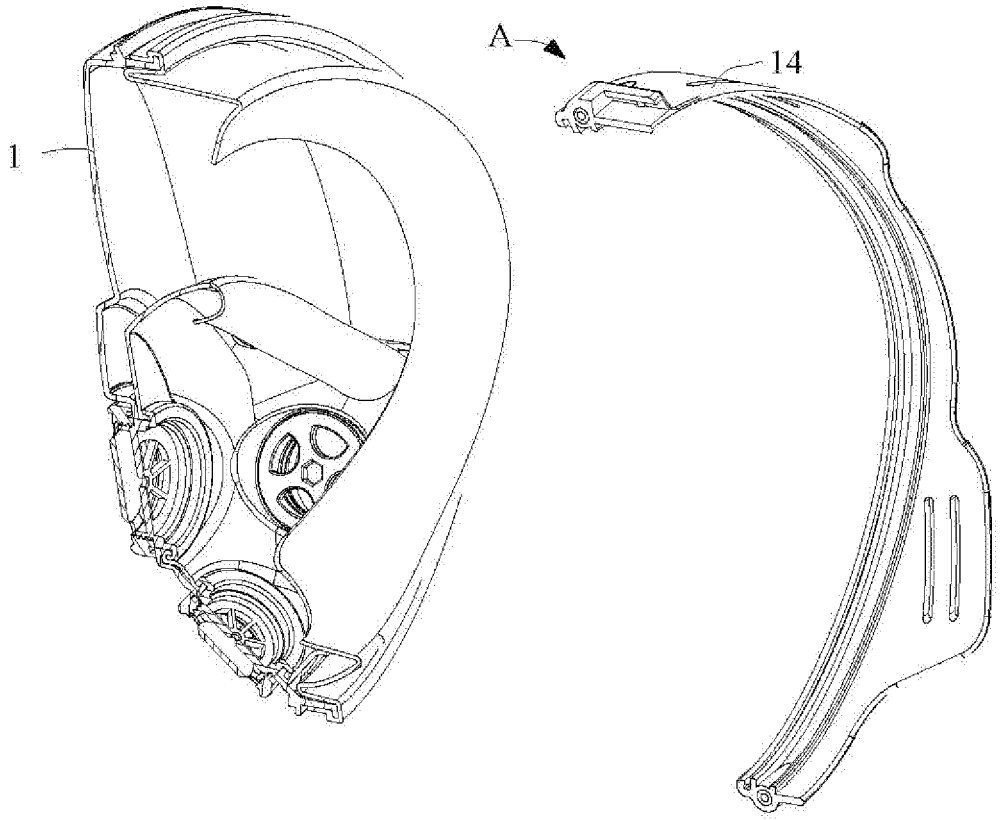
FIG. 6 is a longitudinal sectional view of the FIG. 5.
Figure 7:
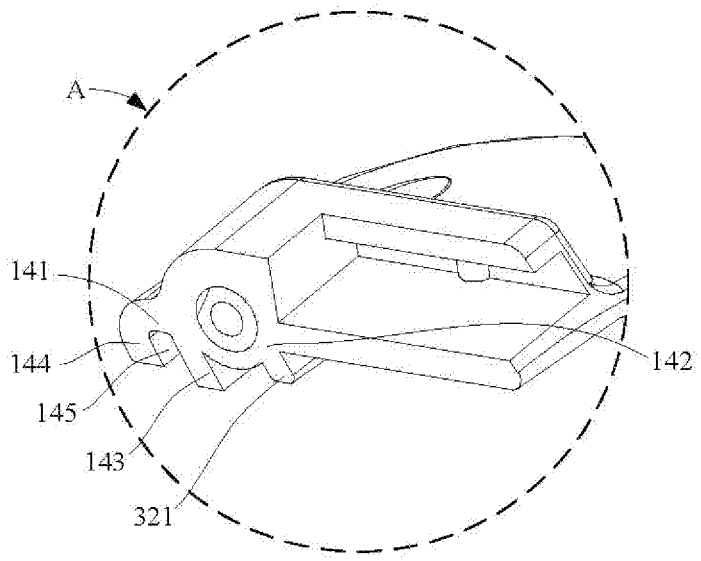
FIG. 7 is a partial magnified view of part A shown in FIG. 6.

Furthermore, in order to ensure a reliable connection between the fixing member 141 of the pressing ring 140 and the mask 10, referring from FIG. 5 to FIG. 7, the fixing member 141 comprises: a first annular baffle 143 and a second annular baffle 144 arranged along the inner surface of the pressure ring 140 and protruding to the inner side, and an annular slot 145 formed between and separating the first annular baffle 143 and the second baffle 144. The peripheral surface of the edge of the wearable opening 120 is provided with an annular fixing rib 130 for matching with the annular slot 145. The annular fixing rib 130 matches with the annular slot 145, thus the pressing ring 140 is fixed on, the mask 10, which prevents the pressing ring 140 falling from the mask 10, and ensures the protective pad 13 firmly clamped between the pressing ring 140 and the mask 10.

It's understandable that the annular fixing rib 130 can be hermetically inserted in the annular slot 145, so as to form a first sealing and waterproof structure between the pressing ring 140 and the mask 10, thus reducing the probability of water leakage around the wearing opening 120 of the mask 10.

Figure 8:
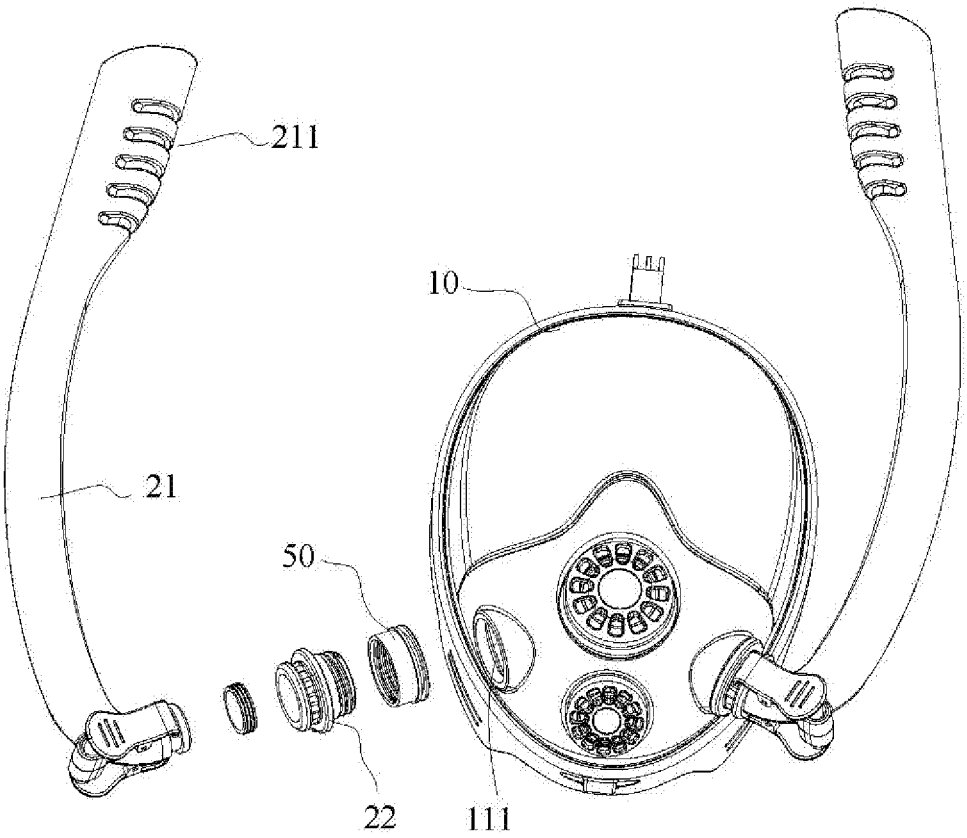
FIG. 8 is an exploded view of the first breathing tube shown in FIG. 1.

In another embodiment, as shown in FIG. 8, the first, breathing tube assembly 20 is rotatably mounted on the mask 10 so that the first breathing tube assembly 20 can rotate relatively to the mask 10, which can, when the user adjusts his swimming/diving postures, ensure an air inlet 211 of the first breathing tube assembly 20 is always above water surface. In other words, the snorkeling breathing apparatus 1 is not only suitable for freestyle, breaststroke, but also suitable for the backstroke and other swimming postures, which makes the application scenario of the snorkeling breathing apparatus 1 more extensive and significantly improves the applicability of the snorkeling breathing apparatus 1.

In some better embodiments, the first breathing tube assembly 20 can rotate 360 degrees relative to the mask 10, thus making, it convenient for the users to adjust the rotational position of the first breathing tube assembly 20 so as to adapt to more swimming postures.

As above, the first breathing tube assembly 20 can be directly provided on the breathing mask 12, or the first breathing tube 21 is indirectly provided on the breathing mask 12 through a connector. In this embodiment, the above first breathing tube assembly 20 is preferably indirectly provided on the breathing mask 12 through the non-return inhaling valve 22 and the specific installation structure is as follows.

As shown in FIG. 8, the snorkeling breathing apparatus 1 comprises the non-return inhaling valve 22, which provided with a first end and a second end opposite to each other. The breathing mask 12 is provided with the first mounting hole 111 which is hermetically connected to the first end, and the second end is hermetically connected to one end of the first breathing tube 21, besides, the other end of the first breathing tube 21 is rotationally connected to the second end.

It's understandable that the non-return inhaling valve 22 does not need to rotate relative to the breathing mask 12 thereby improving the sealing performance of the connection between the first end of the non-return inhaling valve 22 and the breathing mask 12, meanwhile it can simplify the structure of the breathing mask 12, which helps to low the injection manufacturing costs of the mask 10.

In addition, in this embodiment, preferably, the non-return inhaling valve 22 is provided with a non-return valve diaphragm (namely valve sheet 224) which is used for conducting the second end and the first end in non-return successively when the user inhales. That is, when the user inhales, there will be negative pressure in the breathing chamber 121, which will cause the non-return valve diaphragm to shrink and wind towards the breathing chamber 121, thus making the second end and the first end successively conduct in non-return, and air from the first breathing tube assembly 20 goes through the non-return inhaling valve 22 and enters into the breathing chamber 121. When the user exhales (Or the non-return valve diaphragm is in normal state), the non-return valve diaphragm is deployed in the non-return inhaling valve 22, which will isolate the inner of the non-return inhaling valve 22, so as to prevent the first end and the second end from conducting and avoid the air in the breathing chamber 121 going through the non-return inhaling valve 22 and exhaling from the first breathing tube assembly 20.

Figure 9:
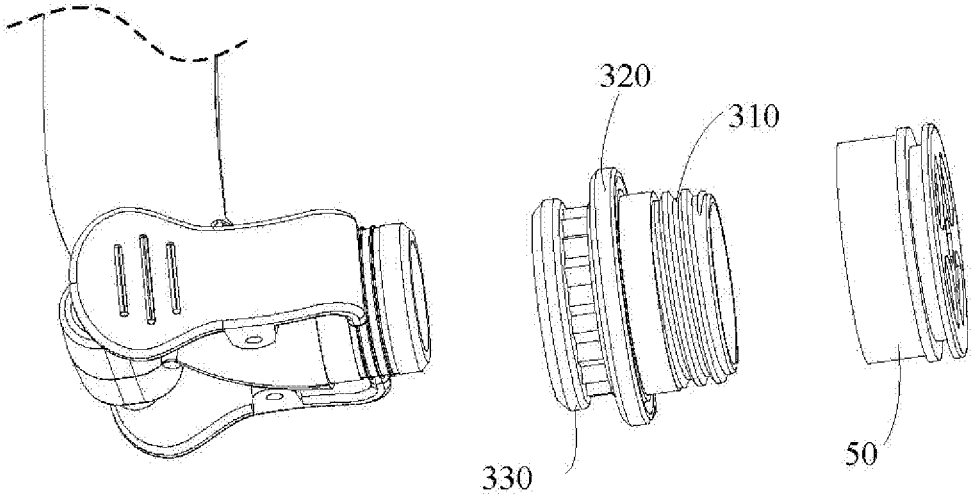
FIG. 9 is a partial magnified view shown in FIG. 8.

Furthermore, referring from FIG. 8 and FIG. 9, the above non-return inhaling valve 22 comprises a first connecting segment 310, a baffling segment 320 and a second connecting segment 330 arranged successively in an axial direction. The first connecting section 310 fixes and runs through the first mounting hole 111, and the baffling segment 320 protrudes from the peripheral surface of the first connecting segment 310 in order to limit the insertion depth of the first connecting segment 310. The snorkeling breathing, apparatus 1 also comprises a fixing sleeve 50 located in the breathing chamber 121, which fixing sleeve 50 is detachably provided on the peripheral surface of the first connecting segment 310 so as to hold and fix the non-return inhaling valve 22 in the first mounting hole 111. One end of the first breathing tube assembly 20 is connected to the second connecting segment 330.

It's understandable that the first connecting segment 310 is provided closely to the first end, and the second connecting segment 330 is provided closely to the second end. The fixing sleeve 50 is mounted on the peripheral surface of the first connecting section 310 through screw thread matched with each other. In this case, both sides of the first mounting hole 111 respectively contact with the baffling, segment 320 and the fixing sleeve 50. That is, the hole wall of the first mounting hole 111 is clamped and fixed between the baffling segment 320 and the fixing, sleeve 50 thus to provide the non-return inhaling valve 22 on the breathing mask 12.

In another embodiment, referring from FIG. 10 to FIG. 14, the non-return exhaust valve 30 particularly comprises:

A valve body 221, which forms a cylinder shape, and the two ends of the valve body 221 in axial direction are configured as an opening. A mounting plate 222 is provided inside the valve body 221, and the periphery edge of the mounting plate 222 is connected to the inner wall of the valve body 221. Ventholes 223 are provided on the mounting plate 222;

A valve sheet 224, which is provided on the mounting plate 222 for opening or covering the ventholes 223, wherein both sides of the mounting plate 222 in the valve body 221 are provided with accommodation space for accommodating the valve sheet 224.

Specifically, the mounting plate 222 can be integrated with the valve body 221, or it also can be fixed on the valve body 221 through welding and bonding, or it can also be fixed on the mounting plate 222 in a detachable assembly mode. In order to facilitate the production and improve the processing efficiency, preferably, the mounting plate 222 is integrated with the valve body 221. The shape of the ventholes 223 is not strictly required, as long as it can ventilate.

Preferably, there are 8 ventholes 223 with a triangle shape distributed equably on the mounting plate 222, so that the mounting plate 222 is in a high strength, and the ventholes 223 take up more space so as to ventilate smoothly.

The way the valve sheet 224 provided on the mounting plate 222 is not strictly required, as long as it is detachable. The valve sheet 224 can be provided on any side of the mounting plate 222. When there is a need to, adjust the ventilation direction of the non-return inhaling valve 22, moving the valve sheet 224 to the other side of the mounting plate 222 is sufficient. For instance, when the valve sheet 224 is provided on, one side of the mounting plate 222, the non-return inhaling valve 22 can be used for inhaling air; while the valve sheet 224 is provided on the other side of the mounting plate 222, the non-return inhaling valve 22 can be used for exhaling air. Thus, the ventilation direction of the non-return inhaling valve 22 is changeable but not limit to a single ventilation direction.

In the invention, the accommodation space for accommodating the valve sheet 224 is provided on both sides of the mounted plate 222 in the valve body 221 of the non-return inhaling valve 22, thus valve sheet 224 can be set on any side of the mounted plate 222. By setting valve sheet 224 on different side of the mounting plate 222, different ventilation directions can be realized.

In order to set the valve sheet 224 on the mounting plate 222, in an embodiment, referring from FIG. 10 to FIG. 14, a second mounting hole 225 is provided in the middle of the mounting plate 222. The valve sheet 224 comprises a sheet body 224*a* and a mounting column 224*b* connected to the sheet body 224*a*, which mounting column 224*b* is fixed on the mounting plate 222 through the second mounting hole 225. The mounting column 224*b* is, provided with a card slot, and the mounting column 224*b* puts the valve sheet 224 on the mounting plate 222 through the card slot so as to fix the valve sheet 224 on the valve body 221.

Furthermore, a ring cylinder 226 is arranged between the periphery of the mounting plate 222 and the inner wall of the valve body 221, and the sheet body 224*a* is overlapped on one of the end face of the ring cylinder 226 in axial direction. The sheet body 224*a* can be overlapped on any end face in axial direction of the ring cylinder 226; on which end face the sheet body 224*a* overlapped can achieve different ventilation direction. By providing with the ring cylinder 226, thus the sheet body 224*a* is overlapped on the ring cylinder 226; in the case that the non-return inhaling valve 22 does not ventilate, there is a good sealing effect between the sheet body 224 and the ring cylinder 226.

Figure 10:
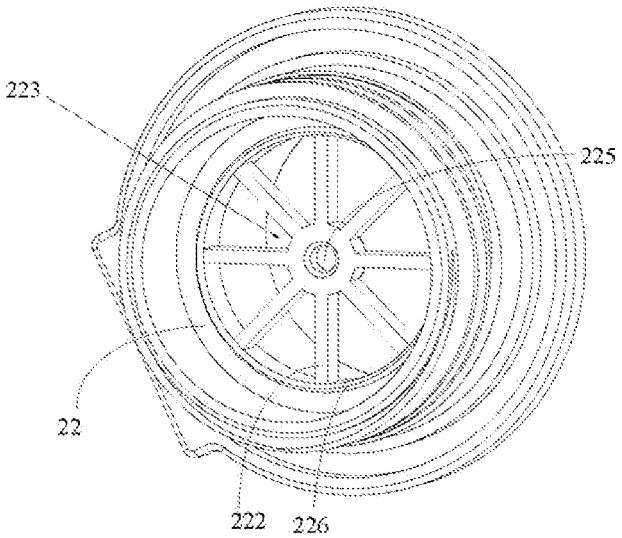
FIG. 10 is a schematic view of the structure of a non-return inhaling valve.
Figure 11:
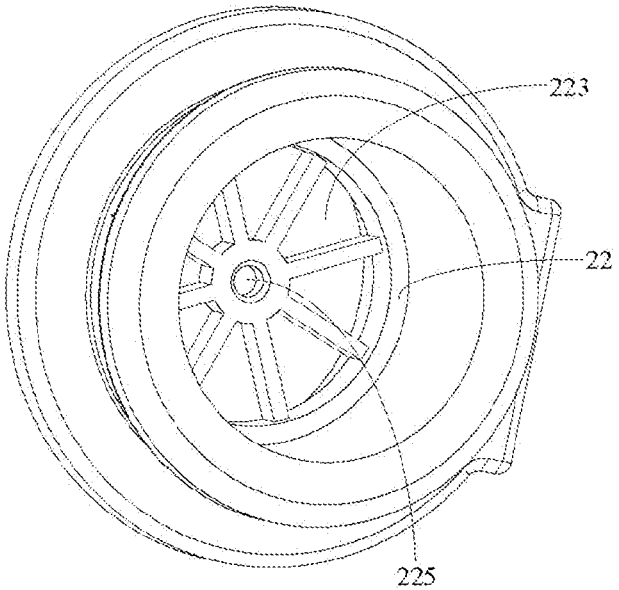
FIG. 11 is another schematic view of the structure of the non-return inhaling valve.
Figure 12:
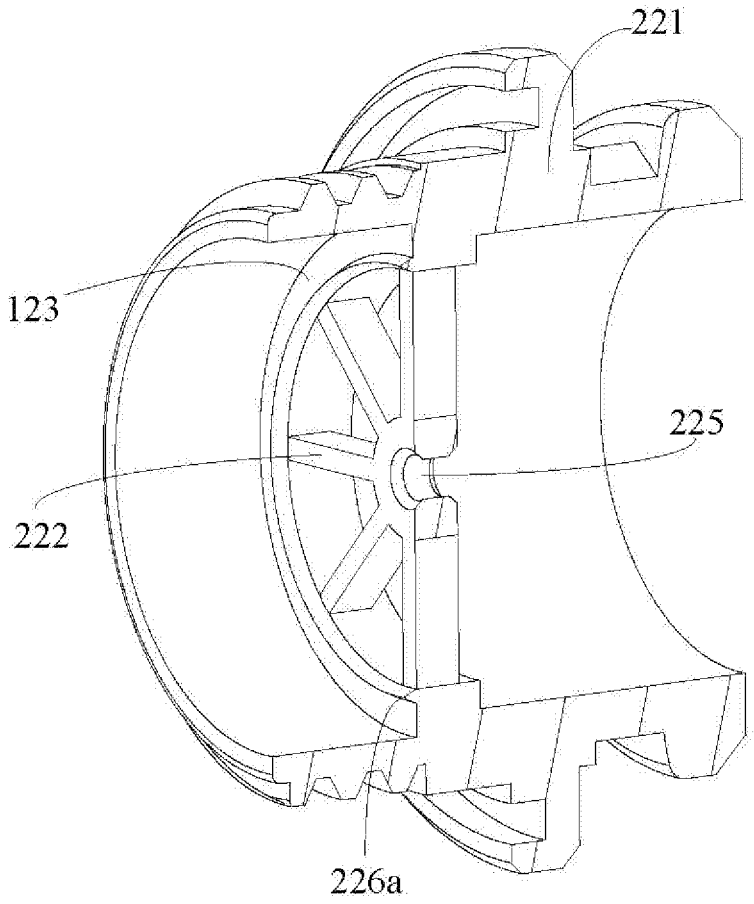
FIG. 12 is a schematic view of the internal structure of the non-return inhaling valve.
Figure 13:
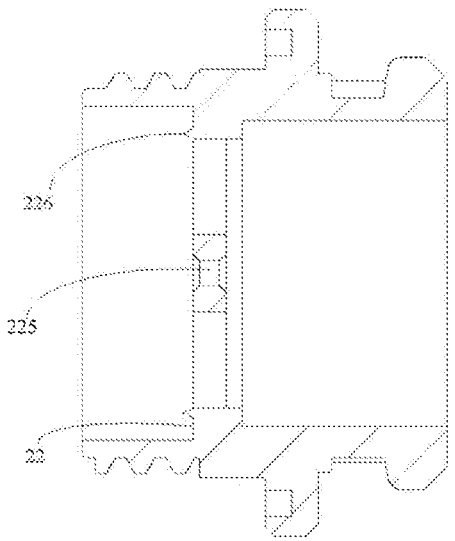
FIG. 13 is another schematic view of the internal structure of the non-return inhaling valve.
Figure 14:
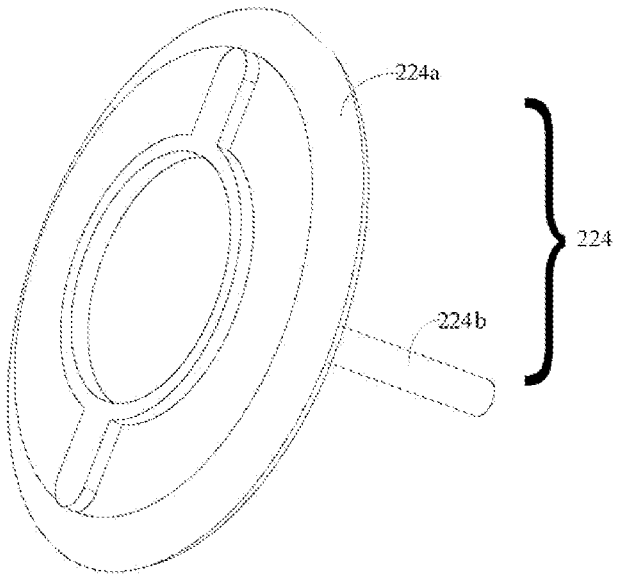
FIG. 14 is a schematic view of the structure of a valve sheet in the non-return inhaling valve.

In order to achieve a better matching relationship between the sheet body 224*a* and the ring cylinder 226, in one of better embodiments, as shown in FIG. 10. FIG. 12 and FIG. 13, a convex rib 226*a* is provided on the end face in axial direction of the ring cylinder 226 and the section of the convex rib 226*a* is in a triangular. At the periphery of the plate valve 224*a* is overlapped on the convex rib 226*a*; there is a further sealing effect between the plate valve 224*a* and the ring cylinder 226, in the case of no ventilation, it has double sealing effect.

The above descriptions are only some preferred embodiments of the present invention, which descriptions do not limit the scope of the patent of the invention. Anyone who utilizes the descriptions of the present invention and the equivalent structure transformation, of the appended drawings content under the invention conception of the present invention or directly/indirectly uses the other related technical fields, are all contained in the scope of the patent of the invention.

What is claimed is:

1. A snorkeling breathing apparatus, comprises:

a mask comprising an outer mask and a breathing mask, the breathing mask being provided within the outer mask and equipped with a breathing chamber;

a first breathing tube assembly comprising a first breathing tube and a non-return inhaling valve, the first breathing tube being connected to the breathing mask through the non-return inhaling valve; and the non-return inhaling valve being connected and mounted on the outer mask, wherein when a user inhales, the non-return inhaling valve turns on and an external air enters the breathing chamber through the first breathing tube; when the user exhales, a non-return exhaust valve turns on and an exhaled air flows from the breathing chamber to outside of the outer mask;

wherein the non-return inhaling valve comprises: a valve body being arranged in a cylinder shape, and both two ends of the valve body in axial direction are configured as an opening, the valve body being equipped inside with a mounting plate, a periphery edge of the mounting plate being connected to an inner wall of the valve body, the mounting plate being equipped with ventholes; a valve sheet being provided on the mounting plate for opening or covering the ventholes, both sides of the mounting plate in the valve body being provided with accommodation space for accommodating the valve sheet, wherein a second mounting hole is arranged in the middle of the mounting plate, the valve sheet comprises a sheet body and a mounting column connected to the sheet body, and the mounting column runs through the second mounting hole and fixes on the mounting plate.

2. The snorkeling breathing apparatus according to claim 1, wherein the non-return exhaust valve comprises a first non-return exhaust valve and a second non-return exhaust valve.

3. The snorkeling breathing apparatus according to claim 2, wherein when the user exhales the first non-return exhaust valve conducts; and the second non-return exhaust valve is connected with an airflow sensor to control a conducting or a closing state of the second non-return exhaust valve according to a volume of exhaled air.

4. The snorkeling breathing apparatus according to claim 1, wherein the snorkeling breathing apparatus further comprises a V-shaped strip, the V-shaped strip being provided on an upper portion of the breathing mask for fitting with the user's face.

5. The snorkeling breathing apparatus according to claim 1, wherein the outer mask is equipped with a wearable opening to fit with the user's face;

the outer mask comprises:

a protective pad extending along an edge of the wearable opening, the protective pad being provided on a peripheral surface of the edge of the wearable opening; and a pressing ring being arranged around the peripheral surface of the wearable opening, wherein an inner surface of the pressing ring comprises a fixing member and a compressing-jointing member arranged along the pressing ring in an axial direction, the compressing-jointing member is arranged near the wearable opening, the fixing member is connected to the peripheral surface of the edge of the wearable opening, and the protective pad is hermetically positioned on the peripheral surface of the edge of the wearable opening by the compressing-jointing member.

6. The snorkeling breathing apparatus according to claim 5, wherein the fixing member comprises a first annular baffle and a second annular baffle being arranged along the inner surface of the pressing ring and protruding to an inner side, and an annular slot being formed between and separating the first and second annular baffle, the peripheral surface of the edge of the wearable opening is provided with an annular fixing rib for matching with the annular slot.

7. The snorkeling breathing apparatus according to claim 1, wherein the snorkeling breathing apparatus further comprises a second breathing tube assembly comprising a second breathing tube and a second non-return valve, the second breathing tube being connected to the breathing mask through the second non-return valve; alternatively, the second non-return valve being arranged in the second breathing tube and the second breathing tube being connected to the breathing mask, directly.

8. The snorkeling breathing apparatus according to claim 7, wherein the second non-return valve used as a second non-return inhaling valve, and the second breathing tube is connected to the breathing mask via the second non-return inhaling valve.

9. The snorkeling breathing apparatus according to claim 7, wherein the first breathing tube assembly and the second breathing tube assembly are rotatably connected to the breathing mask.

10. The snorkeling breathing apparatus according to claim 9, wherein the non-return inhaling valve is provided with a first end and a second end opposite to each other, the breathing mask is provided with a first mounting hole, the first end is hermetically connected to the first mounting hole, the second end is hermetically connected to one end of the first breathing tube, and the end of the first breathing tube is rotatably connected to the second end.

11. The snorkeling breathing apparatus according to claim 10, wherein the non-return inhaling valve comprises a first connecting segment, a baffling segment and a second connecting segment arranged successively in an axial direction, the first connecting segment fixes and runs through the first mounting hole, the baffling segment protrudes from a peripheral surface of the first connecting segment to limit the insertion depth of the first connecting segment;

the non-return inhaling valve further also comprises a fixing sleeve located in the breathing chamber, which fixing sleeve is detachably provided on the peripheral surface of the first connecting segment so as to fixedly hold the non-return inhaling valve in the first mounting hole; the end of the first breathing tube is connected to the second connecting segment.

12. The snorkeling breathing apparatus according to claim 1, wherein a ring cylinder is also provided between a periphery of the mounting plate and the inner wall of the valve body, and the sheet body overlaps on one of an end face of the ring cylinder in an axial direction.

13. The snorkeling breathing apparatus according to claim 12, wherein the end face of the ring cylinder is provided with a convex rib, and the sectional view of the convex rib is formed as a triangular shape.

* * * * *